US006196892B1

(12) United States Patent
Danneberg

(10) Patent No.: US 6,196,892 B1
(45) Date of Patent: Mar. 6, 2001

(54) KIT FOR TOPS

(76) Inventor: Holger Danneberg, Ziegelei Molbath, D-29562, Suhlendorf (DE)

( * ) Notice: Under 35 U.S.C. 154(b), the term of this patent shall be extended for 0 days.

(21) Appl. No.: 09/357,139

(22) Filed: Jul. 20, 1999

(30) Foreign Application Priority Data

Jul. 23, 1998 (DE) ..... 298 13 027 U
May 4, 1999 (DE) ..... 299 07 861 U

(51) Int. Cl.[7] ..... A63H 1/00
(52) U.S. Cl. ..... 446/256; 493/355; 493/373
(58) Field of Search ..... 493/355, 397, 493/340, 342, 350, 373, 82, 83; 446/87, 88, 256, 257, 214, 265, 266, 236, 297

(56) References Cited

U.S. PATENT DOCUMENTS 1,999,314 * 4/1935 Anderson ..... 493/355 X
2,739,415 3/1956 Roberton et al. .
2,945,696 * 7/1960 Johannengmeier ..... 446/265 X
3,741,079 * 6/1973 Bossoms et al. ..... 493/350 X
3,793,928 * 2/1974 Wootten ..... 493/350
4,301,614 11/1981 Newton .
4,906,216 * 3/1990 Abeshouse ..... 446/256
4,954,116 9/1990 Rubino .
5,755,608 5/1998 Glickman .

* cited by examiner

*Primary Examiner*—D. Neal Muir
(74) *Attorney, Agent, or Firm*—Nixon Peabody LLP; David S. Safran

(57) ABSTRACT

A kit for spinning tops having an spindle, at least one body element which has a hole roughly in the area of its center of gravity and which constitutes the body of the top, with a cross section which is essentially equal to the cross section of the spindle, a lower support and an upper support which can be placed on the spindle, at least one of the supports being made to be removed or pulled off from the top body. In accordance with another feature, the kit has a plate-shaped carrier with a recess in which a spindle is supported, with at least one body element being a flat, punch-out top body supported in a punch-out hole in the carrier of the same outline.

10 Claims, 2 Drawing Sheets

KIT FOR TOPS

BACKGROUND OF THE INVENTION

1. Field of the Invention

The invention relates to toys, particularly spinning tops and a kit for making such spinning tops.

2. Description of Related Art

Tops formed as kits, i.e., of separate parts that can be assembled and modified by the user are known; see, U.S. Pat. Nos. 5,755,608 and 4,954,116. However, such tops are complex and costly to an extent limiting the market for them, and also rendering them, on the one hand, unsuitable for young children, and on the other hand, lack the degree of variety and versatility necessary to adequately stimulate the young mind.

SUMMARY OF THE INVENTION

The primary object of the present invention is to make available a kit for spinning tops, with which children can easily make different kinds of spinning tops, and in which their creativity in terms of combinations of colors and shapes will be playfully stimulated, without being unduly complex or costly.

This object is achieved by a kit for spinning tops having an spindle, at least one element which has a hole roughly in the area of its center of gravity and which constitutes the body of the top, with a cross section which is essentially equal to the cross section ofthe spindle, a lower support and an upper support which can be placed on the spindle, at least one of the supports being made to be removed or pulled off from the top body as well as by a kit having a plate-shaped carrier with a pin-shaped recess in which a pin-shaped spindle is supported, and with at least one flat, punch-out top body supported in a punch-out hole of the same outline, the at least one top body having a center opening which is matched to the diameter of the pin-shaped spindle, exclusive of a pointed area thereof.

The invention is explained in detail below with reference to the accompanying figures which schematically shows two preferred embodiment of the invention.

DETAILED DESCRIPTION OF THE INVENTION

Figure 1:
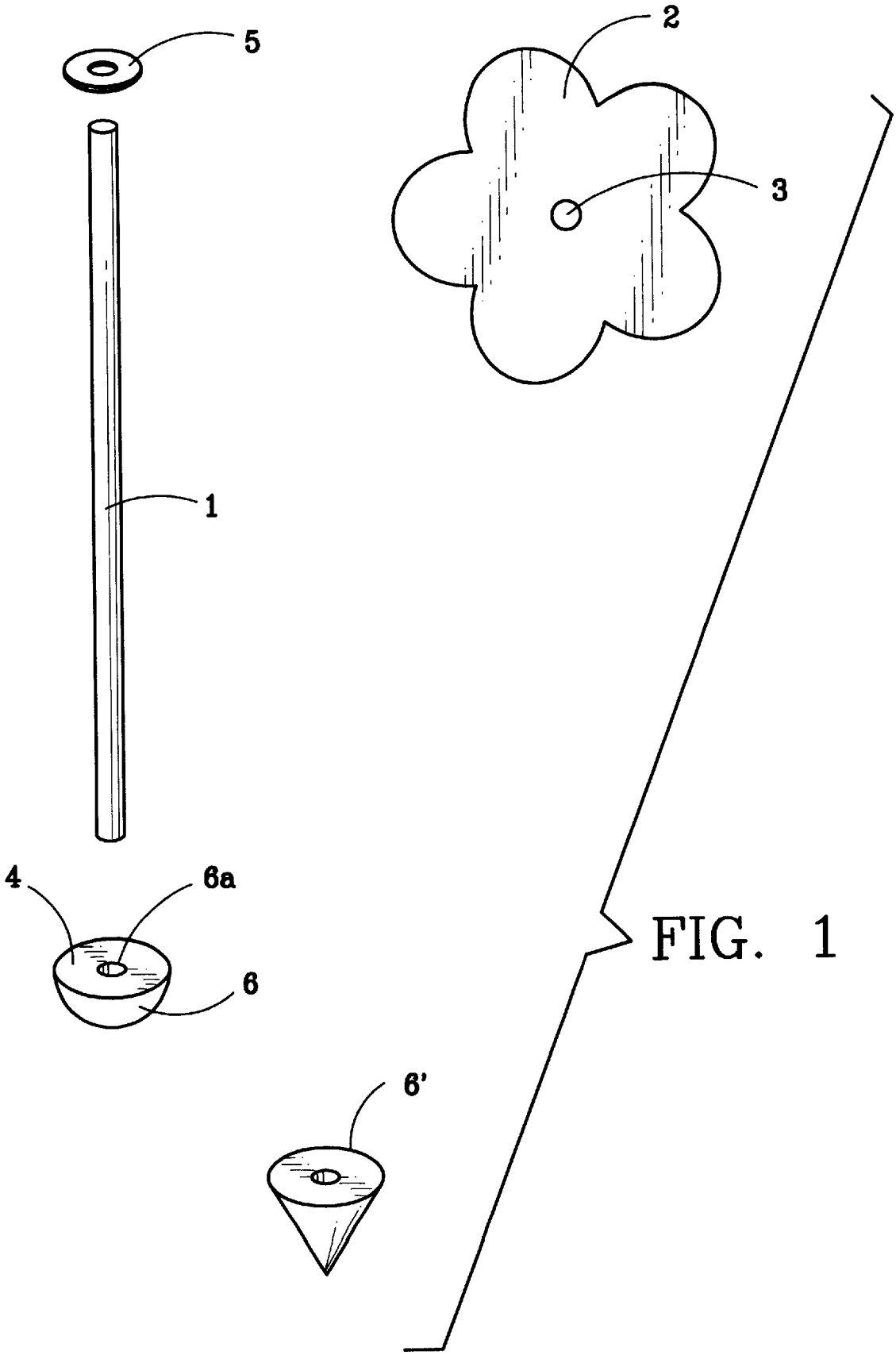
FIG. 1 is an exploded view showing the components of a top in accordance with a first embodiment of the present invention.
Figure 2A:
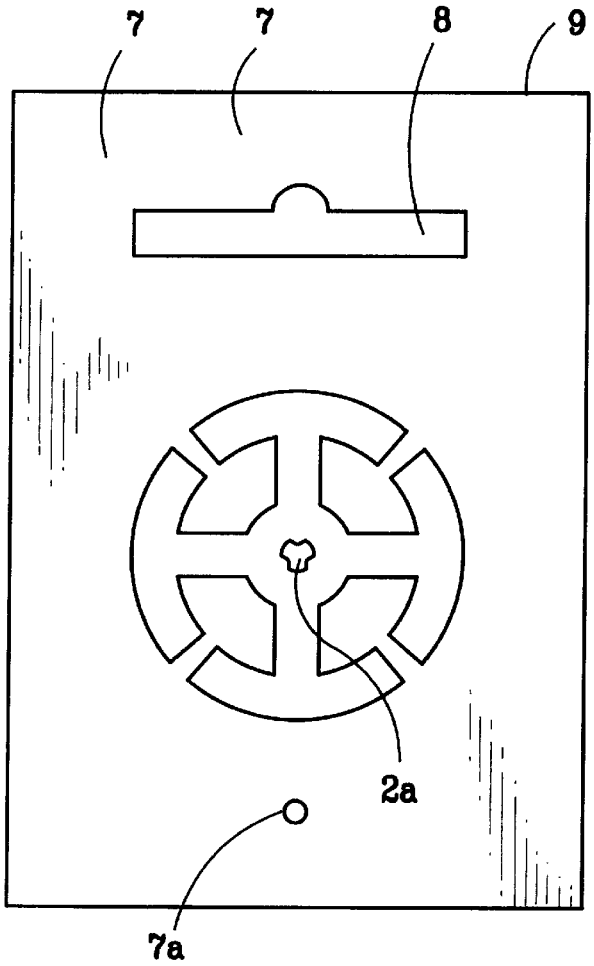
FIG. 2A shows a carrier for the body and spindle of a spinning top in accordance with a first embodiment of the present invention.
Figure 2B:
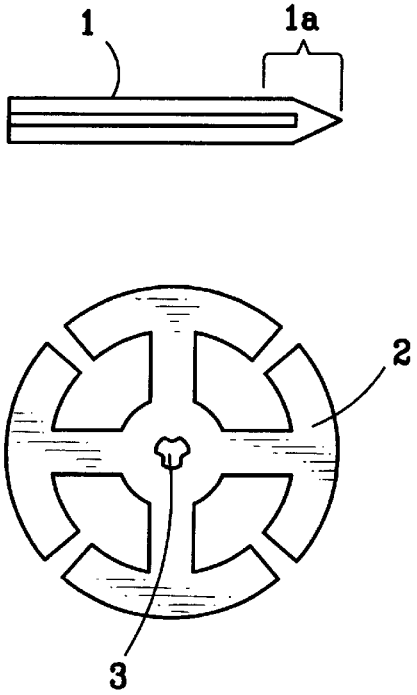
FIG. 2B shows the body and spindle to be carried by the carrier of FIG. 2A as a kit in accordance with the present invention.

The kit for a spinning top as shown in FIGS. 1 and 2 comprises a top spindle 1, preferably made of wood. The top spindle 1 can be pushed into a hole 3 in one or more planiform elements 2, the cross section of the hole 3 and the cross section of the spindle 1 being matched to one another such that the spindle 1 can be pushed on with a low expenditure of force, but without slipping within the hole 3. The hole 3 is preferably located at the center of gravity or center of equilibrium of the element 2 in order to ensure stabilization of the top.

The lower end of the spindle 1 of the top is made to be inserted and fixed into the hole 6*a* of a hemispherical or conical component 6, 6'. The planar upper surface of the components 6, 6' is used as a lower support 4 for the planiform element 2. The upper support is a rubber ring 5 which is pushed onto the top spindle 1 and locked after the element(s) 2 is(are) pushed on, so that the element(s) 2 is/are fixed between the lower support 4 and the top support 5.

In the kit in accordance with the invention, a plurality of planiform elements 2 are provided which have different shapes, diameters and/or colors, and thus, if desired they can be arranged on top of one another, optionally with an interposed spacer (for example, an additional rubber ring 5), to produce different types of tops.

Preferably, the lower element 2 which rests on the lower support 4 is made of a rigid material, while the elements which can be arranged on top are made of cloth, paper, fur, leather gauze, wickerwork; preferably, the elements are made in the form of flower petal wreaths or especially rotationally-symmetrical forms.

Another embodiment is shown in FIG. 2 in which a solid, plate-shaped carrier 7, preferably of wood or plastic with a thickness of roughly 3 mm and a rectangular base shape with dimensions of roughly 10 cm×roughly 15 cm is provided. A flat top body 2 which is located in the punch-out hole 2*a* is punched out of this plate-shaped carrier for use.

To enable punching out of the body 2 from the carrier 7, preferably by laser is used to cut out the form of the body 2 from the remainder of the carrier 7, leaving at least a small degree of connection between the flat top body 2 and the plate-shaped carrier 7 as a scoring for later removal of the top body 2 from the punch-out hole 2*a*.

The flat top body 2 has a hole 3 in the middle for holding the pin-shaped spindle 1 of the top, this hole 3 preferably having a nonround, point-symmetrical cross section to prevent rotation of the pin 1 against the flat top body 2.

The plate-shaped carrier 7 likewise has a pin-shaped recess 8 in which the pin spindle 1 is supported. The pin axis 1 has a pin-shaped shaft which on one end 1*a* runs out in a tip. The shaft of the pin 1 located above has the same cross section as the hole 3 in the planiform top body 2 for connection and fixing of the pin spindle 1 and the top body 2. The end area 1*a* is configured, optionally, such that it cannot penetrate the hole 3 to serve as a support or stop for the body 2 when it is pushed on from the opposite end. On the carrier plate 7, as an assembly aid there can be a funnel-shaped hole 7*a* for holding the tip of the top pin spindle 1*a*, the tip being inserted and held therein while the top body 2 is pushed onto the spindle 1.

The back of the plate-shaped carrier 7 can be covered with a film-like or layer-like covering 9.

The pin spindle 1 can be fixed by locking it in the pin-shaped recess 8 by correspondingly matched dimensioning; the flat top body 2 and/or the pin spindle 1 can, however, also be secured by an adhesive film which has been detachably applied and which covers the surface of the plate-shaped carrier 7 and of the top body 2 or at least partially covers and fixes the pin spindle 1.

The areas of the plate-shaped carrier 7 adjacent to the planiform top body 2 can be made with colors, graphics or inscriptions in areas according to the symmetry of the top body 2 supported in the carrier 7, their forming a connection or unit of colors, graphics or letters with the adjacent area of the top body 2; these assignments can be selected in terms of content such that, as in the example shown in FIG. 2, when the top body 2 is removed from the recess 2*a,* turned 90° C. and returned to the recess 2*a,* interesting new color, graphic or language assignments of the now adjacent area of the plate-shaped carrier 7 and the flat top body 2 are formed.

The preferred embodiment as shown in FIG. 2 can be made as a postcard by its flat execution and its shape or can be sent within an envelope as a standard letter.

It should be appreciated that, the carrier 7 could be made large enough to hold multiple top bodies, and/or additional thin layers made of cloth, paper, fur, leather gauze, wickerwork with punch-out elements 2 for superpositioning on the body 2' (as described for the FIG. 1 embodiment) can be disposed on the carrier 7 and held thereto, e.g., by the above-mentioned adhesive film or by a film which is adhesive only in certain areas, such as at the edges.

Accordingly, it can be seen how the present invention provides a a kit for spinning tops, with which children can easily make different kinds of spinning tops, and in which their creativity in terms of combinations of colors and shapes will be playfully stimulated, without the top and its manner of assembly from the kit being unduly complex and with the kit having a costly construction.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

I claim:

1. Kit for tops comprising a plate-shaped carrier with a pin-shaped recess in which a pin-shaped spindle is supported, and with at least one flat, punch-out top body supported in a punch-out hole of the same outline as said top body; wherein the at least one top body has a center opening and wherein the pin-shaped spindle, exclusive of a pointed area thereof, has a cross section corresponding to a cross section of the center opening of the flat top body.

2. Kit as claimed in claim 1, wherein the flat top body is partially separated from the plate-shaped support.

3. Kit as claimed in claim 2, wherein the flat top body is punched out of the plate-shaped support except for small scored sites.

4. Kit as claimed in claim 1, wherein a back of the plate-shaped support is covered with a sheet-like or film-like layer.

5. Kit as claimed in claim 4, wherein sheet-like or film-like layer is a printable protective layer.

6. Kit as claimed in claim 4, wherein at least one of the pin spindle and the flat top body is fixed in the carrier by spot cementing to the sheet-like or film-like layer.

7. Kit as claimed in claim 4, wherein at least one of the pin spindle and the flat top body is fixed in the carrier by a detachable adhesive film which at least partially covers over a front side of the carrier.

8. Kit as claimed in claim 1, wherein the plate-shaped carrier has an essentially rectangular shape with dimensions of approximately 10 cm×15 cm.

9. Kit as claimed in claim 1, comprising a plurality of top bodies having at least one of different shapes, diameters and colors relative to each other.

10. Kit as claimed in claim 9, wherein the top bodies comprise a first planiform element made of a rigid material and additional planiform elements which are mountable on top the first planiform element and which are made of a nonrigid material.

* * * * *